US005775183A

United States Patent [19]

Tavianini

[11] Patent Number: 5,775,183

[45] Date of Patent: Jul. 7, 1998

[54] COMPOUND WRENCH APPARATUS

[76] Inventor: James Tavianini, 13375 January Ct., Corona, Calif. 91719

[21] Appl. No.: 680,035

[22] Filed: Jul. 15, 1996

[51] Int. Cl.[6] ..... B25B 13/58

[52] U.S. Cl. ..... 81/57.36; 81/180.1; 81/57.38; 81/55; 81/13; 81/58.1

[58] Field of Search ..... 81/180.1, 13, 55, 81/57.39, 57.36, 52, 58.1

[56] References Cited

U.S. PATENT DOCUMENTS

| | | | |
|---|---|---|---|
| D. 306,127 | 2/1990 | Graham et al. . | |
| D. 325,864 | 5/1992 | Diego . | |
| D. 344,223 | 2/1994 | Kubicek . | |
| 1,050,746 | 1/1913 | Morgan | 81/52 |
| 1,509,258 | 9/1924 | Reiser | 81/55 |
| 1,734,270 | 11/1929 | Olson | 81/55 |
| 4,027,560 | 6/1977 | Packer | 81/57.39 |
| 4,327,611 | 5/1982 | Catanese et al. . | |
| 4,385,533 | 5/1983 | Collins | 81/57.39 |
| 4,406,185 | 9/1983 | Junkers | 81/57.39 |
| 4,530,262 | 7/1985 | Pownall . | |
| 5,421,225 | 6/1995 | Chen . | |
| 5,528,964 | 6/1996 | Smith, Jr. | 81/180.1 |

*Primary Examiner*—Timothy V. Eley
*Assistant Examiner*—Lee Wilson

[57] ABSTRACT

A compound wrench apparatus includes a bolt shaft which includes threads. A bolt head is connected to the bolt shaft at a proximal end of the shaft. A first wrench assembly is engaged by the threads and is proximal to the proximal end of the shaft. A second wrench assembly is engaged by the threads of the shaft and is distal to the first wrench assembly. The first wrench assembly includes a threaded lock nut received on the shaft. A retention bracket is received on the shaft and is located between the lock nut and the implement-receiver. A first wrench member is provided, and a first pivot is connected between the retention bracket and the first wrench member. A brace is connected between the first wrench member and the retention bracket. A first bracket portion of the retention bracket includes a slot which receives the shaft and is oriented perpendicularly to the longitudinal axis. The second wrench assembly includes a threaded carriage received on the shaft. A second wrench member is provided, and a second pivot is connected between the carriage and the second wrench member.

10 Claims, 3 Drawing Sheets

FIG 1
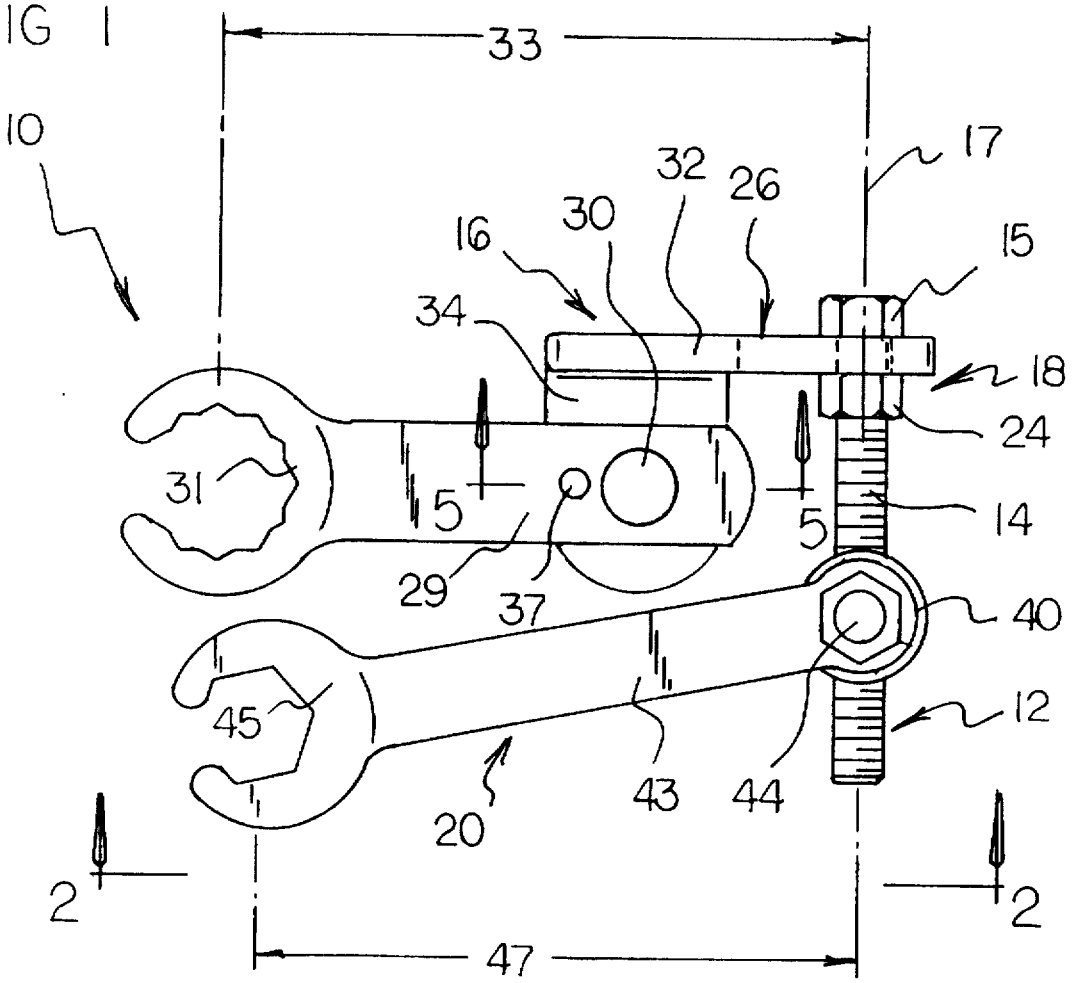
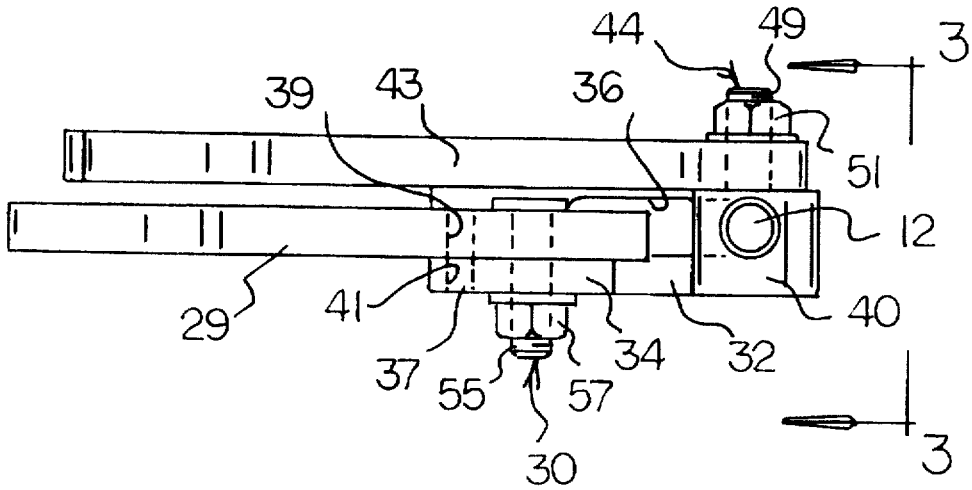
FIG 2

FIG 3
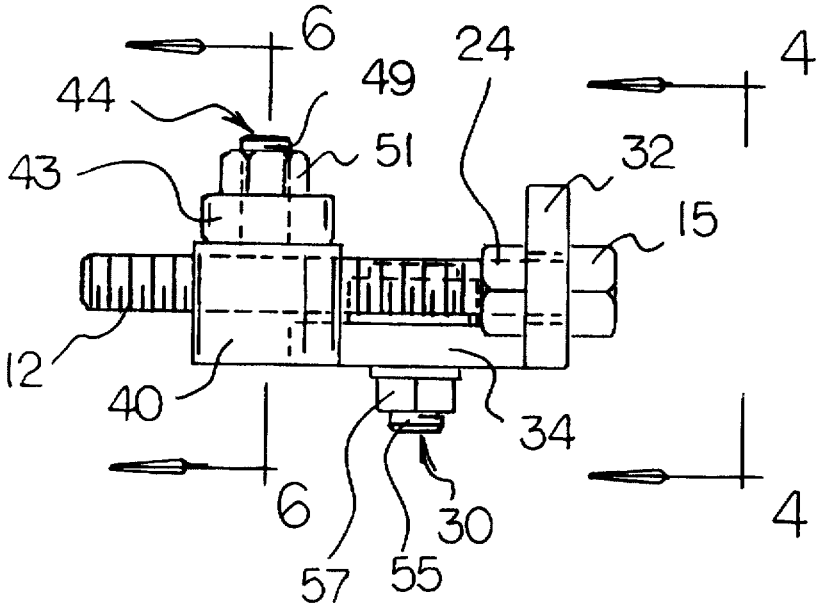
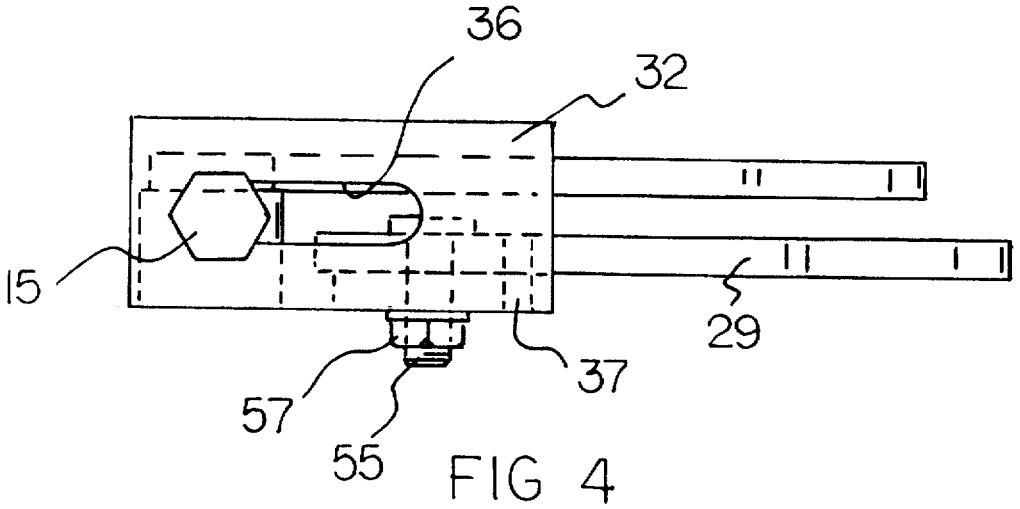
FIG 4

FIG 5
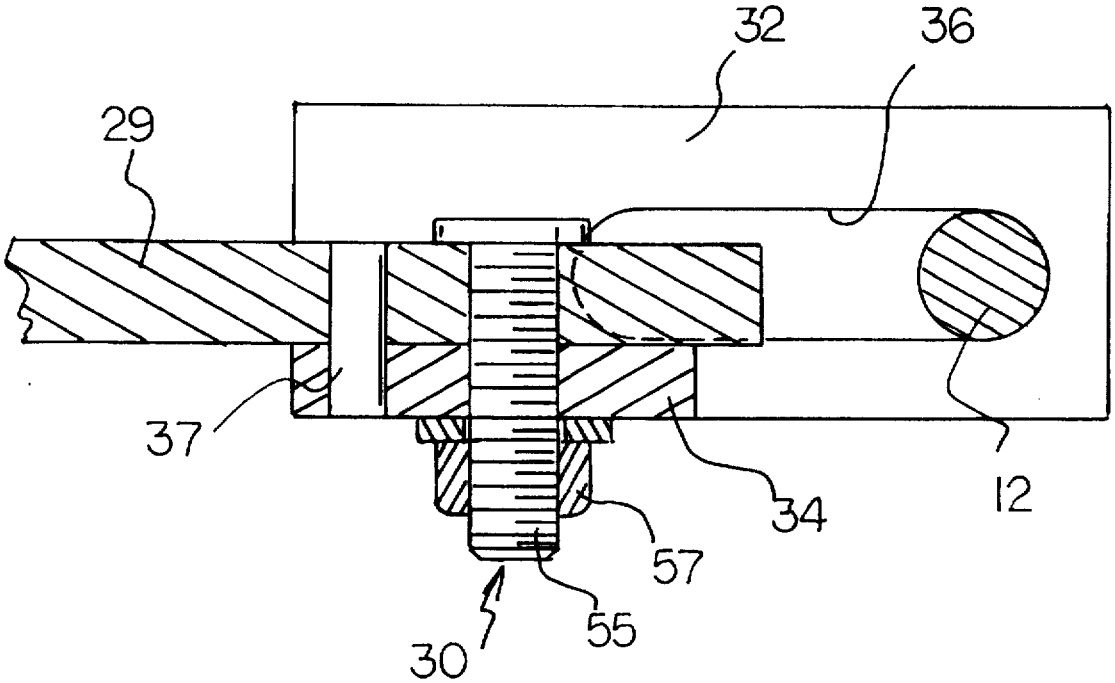
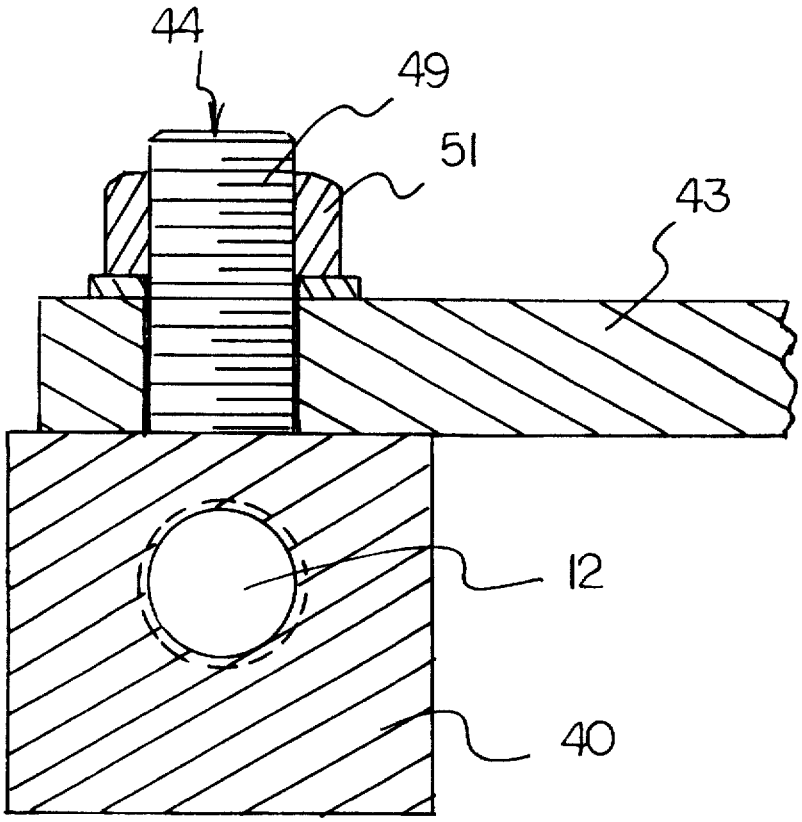
FIG 6

COMPOUND WRENCH APPARATUS

BACKGROUND OF THE INVENTION

1. Field of the Invention

The present invention relates generally to wrenches and, more particularly, to wrenches that include more than one head for turning a fastener.

2. Description of the Prior Art

Wrenches that include more than one fastener-engaging he ad are well known in the art. For example, the following U.S. patents disclose a number of wrenches that include more than one fastener-engaging head: U.S. Pat. Nos. 4,327,611, 4,530,262, Des. 306,127, and Des. 325,864. Each of the above-cited patents is designed so that only one fastener-engaging head is used at a time. There are instances, however, when there is a need to turn two wrenches simultaneously. For example, there are numerous instances in the automotive and plumbing fields wherein it is necessary to turn two wrenches simultaneously in opposite directions to loosen or tighten fittings. In this respect, it would be desirable if a compound wrench were provided which permits two fastener-engaging heads to simultaneously turn in opposite directions.

Generally, in order to turn two wrenches simultaneously in opposite directions, both wrenches must be firmly grasped, one is each hand, and the wrenches must be pushed or pulled in opposite rotational directions, e.g. one clockwise and the other counterclockwise. There are environments, however, when it is difficult for a person to grasp and turn two wrenches simultaneously. For example, to remove and replace a high pressure hydraulic line on a power steering pump of an automobile, there are often relatively small empty spaces under the hood of the automobile. Such small spaces may not permit a person to grasp and turn two wrenches simultaneously. In this respect, it would be desirable if a compound wrench were provided which permits two fastener-engaging heads of a wrench to turn simultaneously without the need for a person to grasp and turn two wrenches simultaneously.

Often when a person grasps two wrenches simultaneously and desires to turn the two wrenches in opposite directions, the person lacks the strength to accomplish the desired turning. To aid such a person in such a circumstance, it would be desirable if a compound wrench were provided which employed a fitting which receives an independent wrench to permit two fastener-engaging wrench heads of the compound wrench to be turned simultaneously.

The following U.S. patents may also be of interest for their disclosure of additional wrenches: U.S. Pat. Nos. 5,421,225 and Des. 344,223.

Thus, while the foregoing body of prior art indicates it to be well known to use compound wrenches, the prior art described above does not teach or suggest a compound wrench apparatus which has the following combination of desirable features: (1) permits two fastener-engaging heads to simultaneously turn in opposite directions; (2) permits two fastener-engaging heads of a wrench to turn simultaneously without the need for a person to grasp and turn two wrenches simultaneously; and (3) employs a fitting which receives an independent wrench to permit two fastener-engaging wrench heads to be turned simultaneously. The foregoing desired characteristics are provided by the unique compound wrench apparatus of the present invention as will be made apparent from the following description thereof other advantages of the present invention over the prior art also will be rendered evident.

SUMMARY OF THE INVENTION

To achieve the foregoing and other advantages, the present invention, briefly described, provides a compound wrench apparatus which includes a shaft which includes threads. An implement-receiver is connected to the shaft at a proximal end of the shaft. A first wrench assembly is engaged by the threads and is proximal to the proximal end of the shaft. A second wrench assembly is engaged by the threads of the shaft and is distal to the first wrench assembly.

The first wrench assembly includes a threaded lock nut received on the shaft. A retention bracket is received on the shaft and is located between the lock nut and the implement-receiver. A first wrench member is provided, and a first pivot is connected between the retention bracket and the first wrench member. A brace is connected between the first wrench member and the retention bracket.

The first wrench member includes a first handle portion connected to the first pivot and includes a first jaw portion connected to the first handle portion. The first jaw portion is spaced from the shaft by a first jaw distance. The retention bracket includes a first bracket portion received on the shaft. The first bracket portion is oriented in a first plane which is perpendicular to the longitudinal axis of the shaft. A second bracket portion is connected to the first bracket portion. The second bracket portion is oriented in a second plane which is parallel to the longitudinal axis. The first pivot is connected between the second bracket portion and the first wrench member.

The brace is in a form of a brace pin connected between the first handle portion of the first wrench member and the second bracket portion of the retention bracket. The first bracket portion of the retention bracket includes a slot which receives the shaft and is oriented perpendicularly to the longitudinal axis. The shaft and the implement-receiver are in a form of a bolt which includes a bolt shaft and a bolt head.

The second wrench assembly includes a threaded carriage received on the shaft. A second wrench member is provided, and a second pivot is connected between the carriage and the second wrench member. The second wrench member includes a second handle portion connected to the second pivot and includes a second jaw portion connected to the second handle portion. The second jaw portion is spaced from the shaft by a second jaw distance. The slot of the retention bracket can be adjusted with respect to the longitudinal axis so that the first jaw distance is approximately equal to the second jaw distance.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining a preferred embodiment of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

It is therefore an object of the present invention to provide a new and improved compound wrench apparatus which has all of the advantages of the prior art and none of the disadvantages.

It is another object of the present invention to provide a new and improved compound wrench apparatus which may be easily and efficiently manufactured and marketed.

It is a further object of the present invention to provide a new and improved compound wrench apparatus which is of durable and reliable construction.

An even further object of the present invention is to provide a new and improved compound wrench apparatus which is susceptible of a low cost of manufacture with regard to both materials and labor, and which accordingly is then susceptible of low prices of sale to the consuming public, thereby making such compound wrench apparatus available to the buying public.

Still yet a further object of the present invention is to provide a new and improved compound wrench apparatus which permits two fastener-engaging heads to simultaneously turn in opposite directions.

Still another object of the present invention is to provide a new and improved compound wrench apparatus that permits two fastener-engaging heads of a wrench to turn simultaneously without the need for a person to grasp and turn two wrenches simultaneously.

Yet another object of the present invention is to provide a new and improved compound wrench apparatus which employs a fitting which receives an independent wrench to permit two fastener-engaging wrench heads to be turned simultaneously.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein:

FIG. 1 is a side view showing a preferred embodiment of the compound wrench apparatus of the invention.

FIG. 2 is a bottom view of the embodiment of the compound wrench apparatus shown in FIG. 1 taken along line 2—2 of FIG. 1.

FIG. 3 is a side view of the embodiment of the compound wrench apparatus of FIG. 2 taken along line 3—3 thereof.

FIG. 4 is a side view of the embodiment of the invention shown in FIG. 3 taken along line 4—4 thereof.

FIG. 5 is an enlarged partial cross-sectional view of a portion of the embodiment of the invention shown in FIG. 1 taken along line 5—5 thereof.

FIG. 6 is an enlarged partial cross-sectional view of a portion of the embodiment of the invention shown in FIG. 3 taken along line 6—6 thereof.

DESCRIPTION OF THE PREFERRED EMBODIMENT

With reference to the drawings, a new and improved compound wrench apparatus embodying the principles and concepts of the present invention will be described.

Turning to FIGS. 1–6, there is shown an exemplary embodiment of the compound wrench apparatus of the invention generally designated by reference numeral 10. In its preferred form, compound wrench apparatus 10 includes a shaft which includes threads 14. An implement-receiver is connected to the shaft at a proximal end 18 of the shaft. A first wrench assembly 16 is engaged by the threads 14 and is proximal to the proximal end 18 of the shaft. A second wrench assembly 20 is engaged by the threads 14 of the shaft and is distal to the first wrench assembly 16.

The first wrench assembly 16 includes a threaded lock nut 24 received on the shaft. A retention bracket 26 is received on the shaft and is located between the lock nut 24 and the implement-receiver. A first wrench member is provided, and a first pivot 30 is connected between the retention bracket 26 and the first wrench member. The first pivot 30 includes bolt 55 and lock nut 57. A brace is connected between the first wrench member and the retention bracket 26. The brace retains the first wrench member at a selected orientation with respect to the retention bracket 26. As shown in the drawings, the brace retains the first wrench member at 90 degrees with respect to the retention bracket 26.

The first wrench member includes a first handle portion 29 connected to the first pivot 30 and includes a first jaw portion 31 connected to the first handle portion 29. The first jaw portion 31 is spaced from the shaft by a first jaw distance 33. The retention bracket 26 includes a first bracket portion 32 received on the shaft. The first bracket portion 32 is oriented in a first plane which is perpendicular to the longitudinal axis 17 of the shaft. A second bracket portion 34 is connected to the first bracket portion 32. The second bracket portion 34 is oriented in a second plane which parallel to the longitudinal axis 17. The first pivot 30 is connected between the second bracket portion 34 and the first wrench member.

The brace is in a form of a brace pin 37 connected between the first handle portion 29 of the first wrench member and the second bracket portion 34 of the retention bracket 26. The first handle portion 29 includes a pin-receiving channel 39, and the second bracket portion 34 includes a pin-receiving channel 41. The brace pin 37 is inserted when the pin-receiving channel 39 and the pin-receiving channel 41 are placed in registration. The first bracket portion 32 of the retention bracket 26 includes a slot 36 which receives the shaft and is oriented perpendicularly to the longitudinal axis 17. The shaft and the implement-receiver are in a form of a bolt which includes a bolt shaft 12 and a bolt head 15.

The second wrench assembly 20 includes a threaded carriage 40 received on the shaft. A second wrench member is provided, and a second pivot 44 is connected between the carriage 40 and the second wrench member. The second pivot 44 includes bolt 49 and lock nut 51. The second wrench member includes a second handle portion 43 connected to the second pivot 44 and includes a second jaw portion 45 connected to the second handle portion 43. The second jaw portion 45 is spaced from the shaft by a second jaw distance 47. The slot 36 of the retention bracket 26 can be adjusted with respect to the longitudinal axis 17 so that the first jaw distance 33 is approximately equal to the second jaw distance 47.

In using the compound wrench apparatus 10 of the invention, the slot 36 of the retention bracket 26 is adjusted along the bolt shaft 12 so that the first jaw distance 33 is approximately equal to the second jaw distance 47. The lock nut 24 can be turned so that the retention bracket 26 is secured in its selected position along the bolt shaft 12. The lock nut 24 squeezes the first bracket portion 32 of the retention bracket 26 between the lock nut 24 and the bolt head 15. The second handle portion 43 is rotated around the longitudinal axis 17 so that the carriage 40 rides up or down the bolt shaft 12 as desired to enable proper positioning of the second jaw portion 45 along with proper positioning of the first jaw portion 31.

More specifically, the first jaw portion 31 is to be placed on a first nut to be rotated by the compound wrench. The second jaw portion 45 is to be placed on a second nut to be rotated by the compound wrench. Often both the first and the second nuts to be rotated by the compound wrench are positioned along a common longitudinal axis. One nut is to be rotated in one direction, i.e. clockwise, and the other nut is to be rotated in the opposite direction, i.e. counterclockwise. With the invention, when the first jaw portion 31 is engaging one nut to be rotated by the compound wrench and when the second jaw portion 45 is engaging another nut to be rotated by the compound wrench when the bolt head 15 is rotated in one direction, the first jaw portion 31 and the second jaw portion 45 will tend to rotate in opposite directions from each other. Therefore, when the bolt head 15 is rotated in one direction, such as clockwise, the first jaw portion 31 and the second jaw portion 45 will rotate with respect to each other in opposite directions so that they tend to tighten adjacent nuts. On the other hand, when the bolt head 15 is rotated in the opposite direction, such as counterclockwise, the first jaw portion 31 and the second jaw portion 45 will rotate with respect to each other in opposite directions so that they tend to loosen the adjacent nuts.

The compound wrench apparatus 10 of the invention is especially useful for facilitating removal and replacement of the high pressure hydraulic line on the steering pump on Lexus automobiles. More specifically, without employing the compound wrench apparatus 10 of the invention, it is necessary to remove the pump pulley in order to gain access to the hydraulic line. However, with using the compound wrench apparatus 10 of the invention, access to the hydraulic line is gained without removing the pump pulley.

The components of the compound wrench apparatus of the invention can be made from inexpensive and durable metal materials.

As to the manner of usage and operation of the instant invention, the same is apparent from the above disclosure, and accordingly, no further discussion relative to the manner of usage and operation need be provided.

It is apparent from the above that the present invention accomplishes all of the objects set forth by providing a new and improved compound wrench apparatus that is low in cost, relatively simple in design and operation, and which may advantageously be used to permit two fastener-engaging heads to simultaneously turn in opposite directions. With the invention, a compound wrench apparatus is provided which permits two fastener-engaging heads of a wrench to turn simultaneously without the need for a person to grasp and turn two wrenches simultaneously. With the invention, a compound wrench apparatus is provided which employs a fitting which receives an independent wrench to permit two fastener-engaging wrench heads to be turned simultaneously.

Thus, while the present invention has been shown in the drawings and fully described above with particularity and detail in connection with what is presently deemed to be the most practical and preferred embodiment(s) of the invention, it will be apparent to those of ordinary skill in the art that many modifications thereof may be made without departing from the principles and concepts set forth herein, including, but not limited to, variations in size, materials, shape, form, function and manner of operation, assembly and use.

Hence, the proper scope of the present invention should be determined only by the broadest interpretation of the appended claims so as to encompass all such modifications as well as all relationships equivalent to those illustrated in the drawings and described in the specification.

Finally, it will be appreciated that the purpose of the foregoing Abstract provided at the beginning of this specification is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

What is claimed as being new and desired to be protected by Letters Patent of the united states is as follows:

1. A compound wrench apparatus, comprising:

a shaft which includes threads, an implement-receiver connected to said shaft at a proximal end of said shaft, a first wrench assembly engaged by said threads proximal to said proximal end of said shaft, and a second wrench assembly engaged by said threads of said shaft distal to said first wrench assembly.

2. The apparatus of claim 1 wherein said first wrench assembly includes:

a threaded lock nut received on said shaft, a retention bracket received on said shaft and located between said lock nut and said implement-receiver, a first wrench member, a first pivot connected between said retention bracket and said first wrench member, and a brace connected between said first wrench member and said retention bracket.

3. The apparatus of claim 2 wherein said first wrench member includes:

a first handle portion connected to said first pivot, and a first jaw portion connected to said first handle portion, wherein said first jaw portion is spaced from said shaft by a first jaw distance.

4. The apparatus of claim 2 wherein said shaft has a longitudinal axis and said retention bracket includes:

a first bracket portion received on said shaft, wherein said first bracket portion is oriented in a first plane which is perpendicular to said longitudinal axis of said shaft, and a second bracket portion connected to said first bracket portion, wherein said second bracket portion is oriented in a second plane which is parallel to said longitudinal axis of said shaft, wherein said first pivot is connected between said second bracket portion and said first wrench member.

5. The apparatus of claim 2 wherein said brace is in a form of a brace pin connected between said first handle portion of said first wrench member and said second bracket portion of said retention bracket.

6. The apparatus of claim 2 wherein said second wrench assembly includes:

a threaded carriage received on said shaft, a second wrench member, and a second pivot connected between said carriage and said second wrench member.

7. The apparatus of claim 6 wherein said second wrench member includes:

a second handle portion connected to said second pivot, and a second jaw portion connected to said second handle portion, wherein said second jaw portion is spaced from said shaft by a second jaw distance.

8. The apparatus of claim 4 wherein said first bracket portion of said retention bracket includes a slot which receives said shaft and is oriented perpendicularly to said longitudinal axis of said shaft.

9. The apparatus of claim 8 wherein said slot of said retention bracket is adjusted with respect to said longitudinal axis of said shaft so that said first jaw distance is approximately equal to said second jaw distance.

10. The apparatus of claim 9 wherein said shaft and said implement-receiver are in a form of a bolt which includes a bolt shaft and a bolt head.

* * * * *